US010974405B2

(12) United States Patent
Rivera

(10) Patent No.: US 10,974,405 B2
(45) Date of Patent: Apr. 13, 2021

(54) FLEXIBLE RAZOR ASSEMBLY

(71) Applicant: Abdiel Rivera, Laureldale, PA (US)

(72) Inventor: Abdiel Rivera, Laureldale, PA (US)

( * ) Notice: Subject to any disclaimer, the term of this patent is extended or adjusted under 35 U.S.C. 154(b) by 0 days.

(21) Appl. No.: 16/568,403

(22) Filed: Sep. 12, 2019

(65) Prior Publication Data

US 2021/0078191 A1 Mar. 18, 2021

(51) Int. Cl.
*B26B 21/10* (2006.01)
*B26B 21/56* (2006.01)

(52) U.S. Cl.
CPC ..... *B26B 21/565* (2013.01); *B26B 21/10* (2013.01)

(58) Field of Classification Search
CPC ..... B26B 21/10; B26B 21/565
USPC ..... 30/53
See application file for complete search history.

(56) References Cited

U.S. PATENT DOCUMENTS 1,338,908 A * 5/1920 Crawford ..... B26B 21/08 30/32
1,350,960 A * 8/1920 Evans ..... B26B 21/10 30/35
1,932,458 A * 10/1933 Hanson ..... B26B 21/10 30/55
2,192,362 A * 3/1940 Merlo ..... B26B 21/08 30/32
3,084,430 A * 4/1963 Pacitti ..... B26B 21/12 30/55
3,388,467 A * 6/1968 Werner ..... B26B 21/08 30/53
3,728,788 A * 4/1973 Pearson ..... B26B 21/08 30/53
3,772,778 A 11/1973 Ishida
4,454,653 A 6/1984 Chen
4,630,365 A 12/1986 Imaizumi
4,887,356 A 12/1989 Rudd
6,082,007 A 7/2000 Andrews
D525,390 S 7/2006 Barbieri
7,131,203 B2 * 11/2006 Wain ..... B26B 21/227 30/57
8,528,214 B2 * 9/2013 Coffin ..... B26B 21/227 30/47
8,806,758 B2 * 8/2014 Pineda ..... B26B 21/10 30/53

* cited by examiner

*Primary Examiner* — Hwei-Siu C Payer

(57) ABSTRACT

A flexible razor assembly for shaving contours on a user's body includes a handle that has a blade channel integrated therein. A lever is pivotally coupled to the handle and a blade case is coupled to the lever. The blade case is positionable in an open position and a closed position and the blade case is bendable to conform to curvature of a user's body. A blade is provided and the blade is comprised of a bendable material. The blade is positionable in the blade case having a cutting edge of the blade being exposed for shaving the user's body.

8 Claims, 6 Drawing Sheets

FLEXIBLE RAZOR ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to razor devices and more particularly pertains to a new razor device for shaving contours on a user's body.

(2) Description of Related Art Including Information Disclosed Under 37 CFR 1.97 and 1.98

The prior art relates to razor devices.

BRIEF SUMMARY OF THE INVENTION

An embodiment of the disclosure meets the needs presented above by generally comprising a handle that has a blade channel integrated therein. A lever is pivotally coupled to the handle and a blade case is coupled to the lever. The blade case is positionable in an open position and a closed position and the blade case is bendable to conform to curvature of a user's body. A blade is provided and the blade is comprised of a bendable material. The blade is positionable in the blade case having a cutting edge of the blade being exposed for shaving the user's body.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
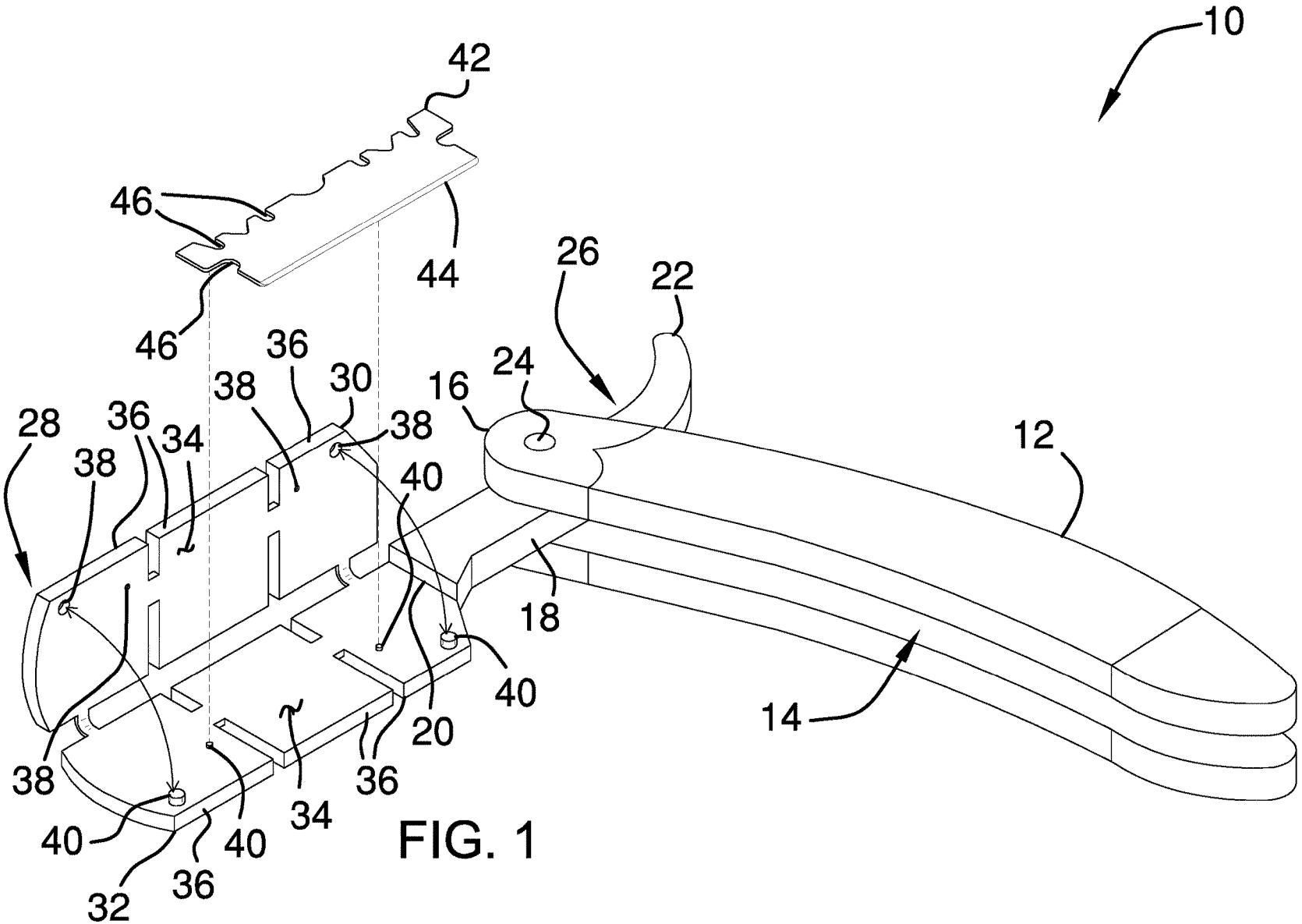
FIG. 1 is a perspective view of a flexible razor assembly according to an embodiment of the disclosure.
Figure 2:
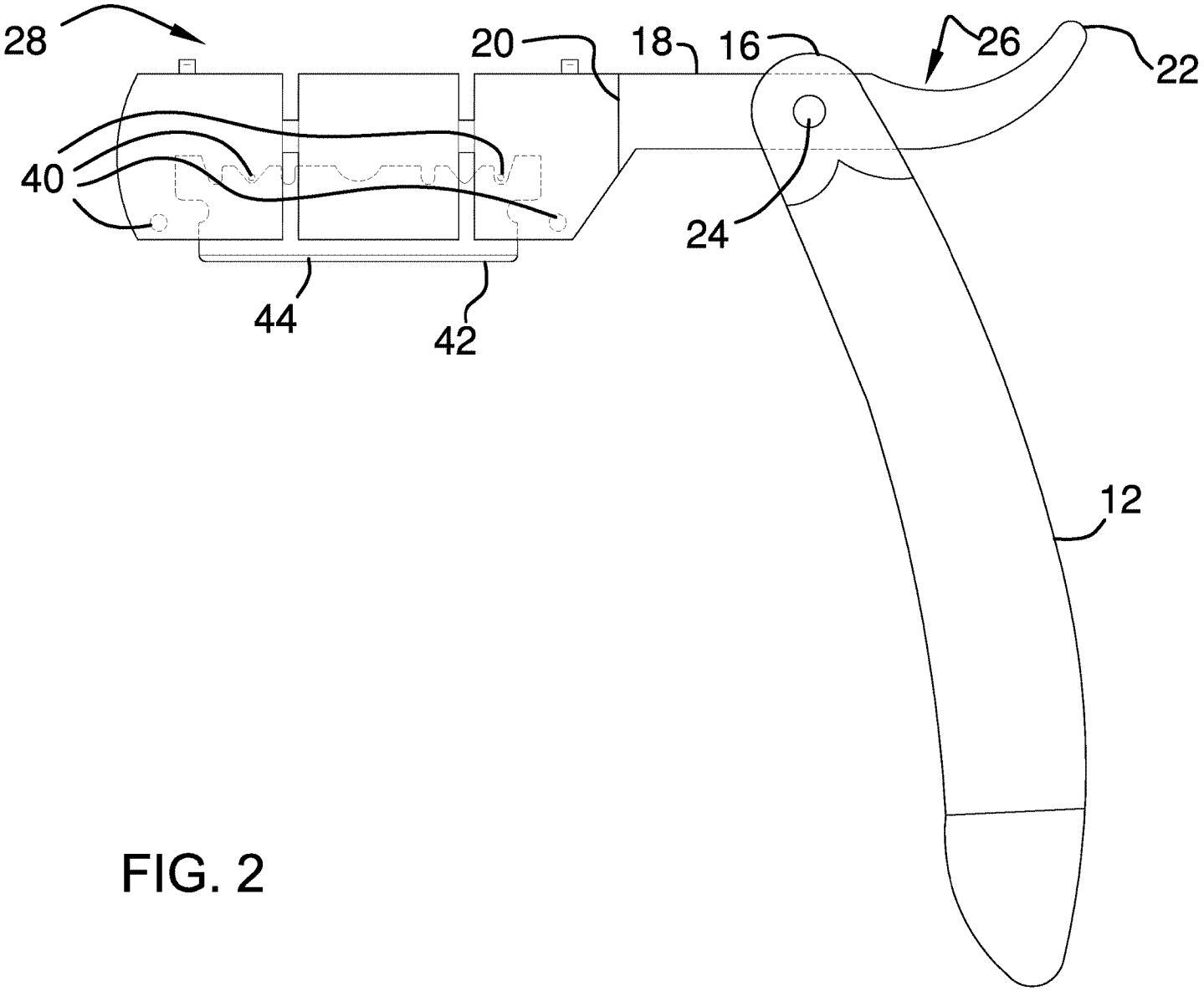
FIG. 2 is a top phantom view of an embodiment of the disclosure.
Figure 3:
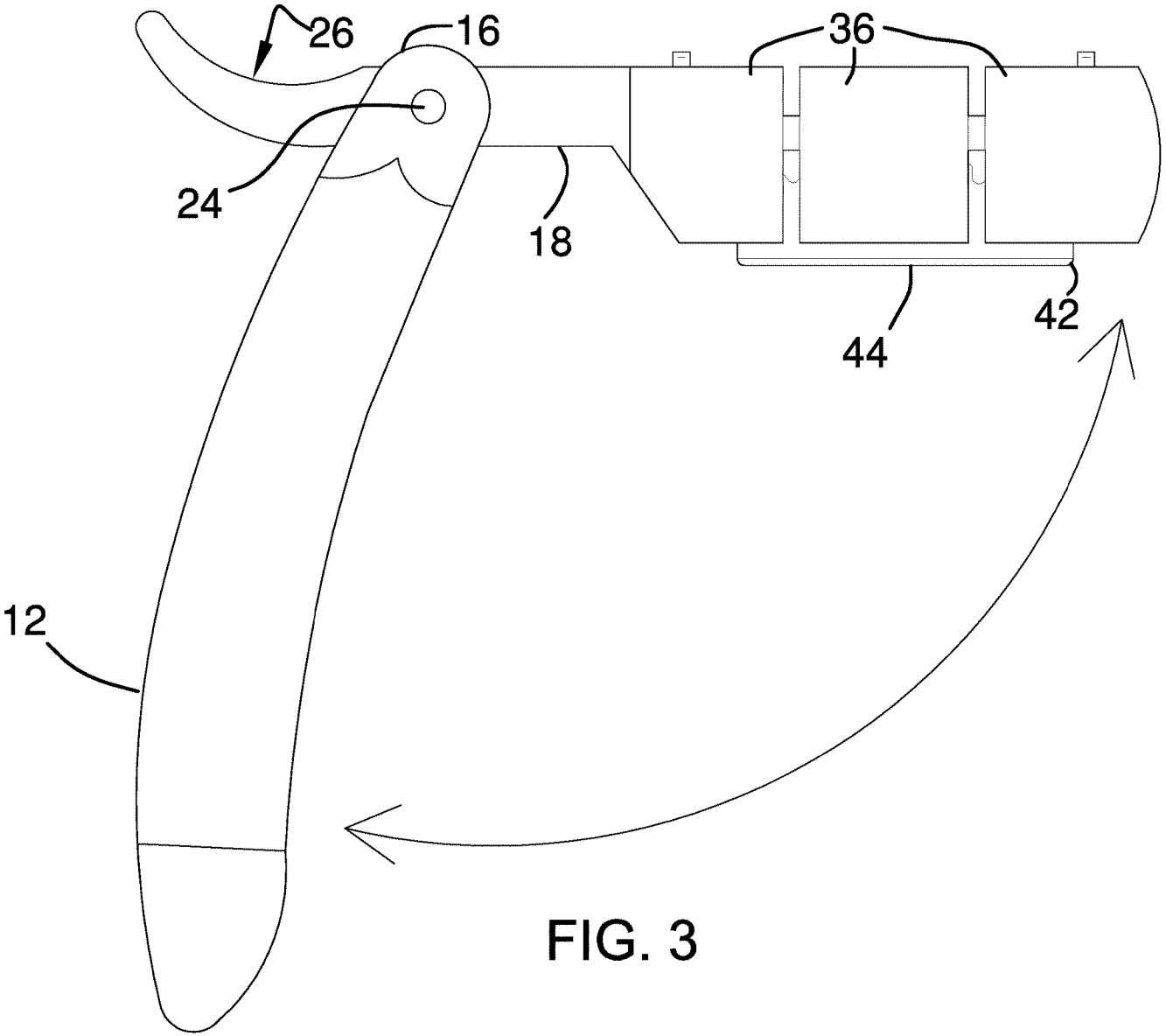
FIG. 3 is a bottom view of an embodiment of the disclosure.
Figure 4:
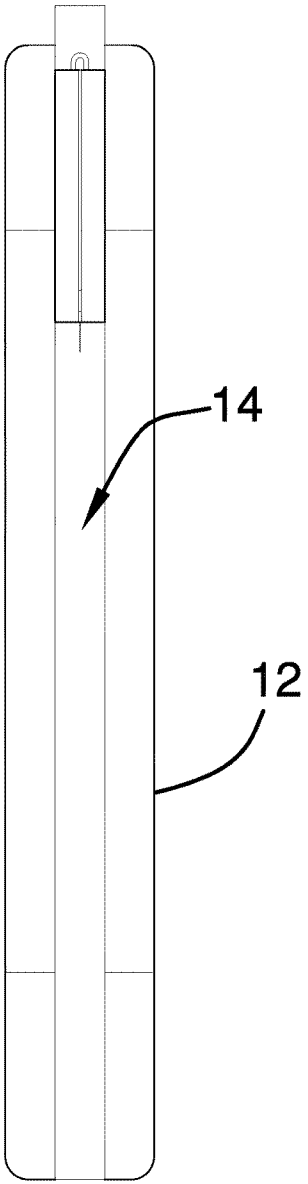
FIG. 4 is a right side view of an embodiment of the disclosure.
Figure 5:
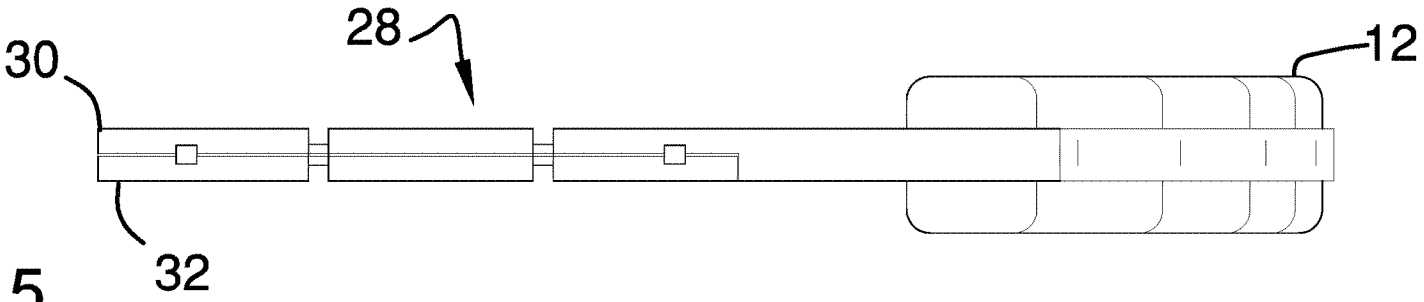
FIG. 5 is a front view of an embodiment of the disclosure.
Figure 6:
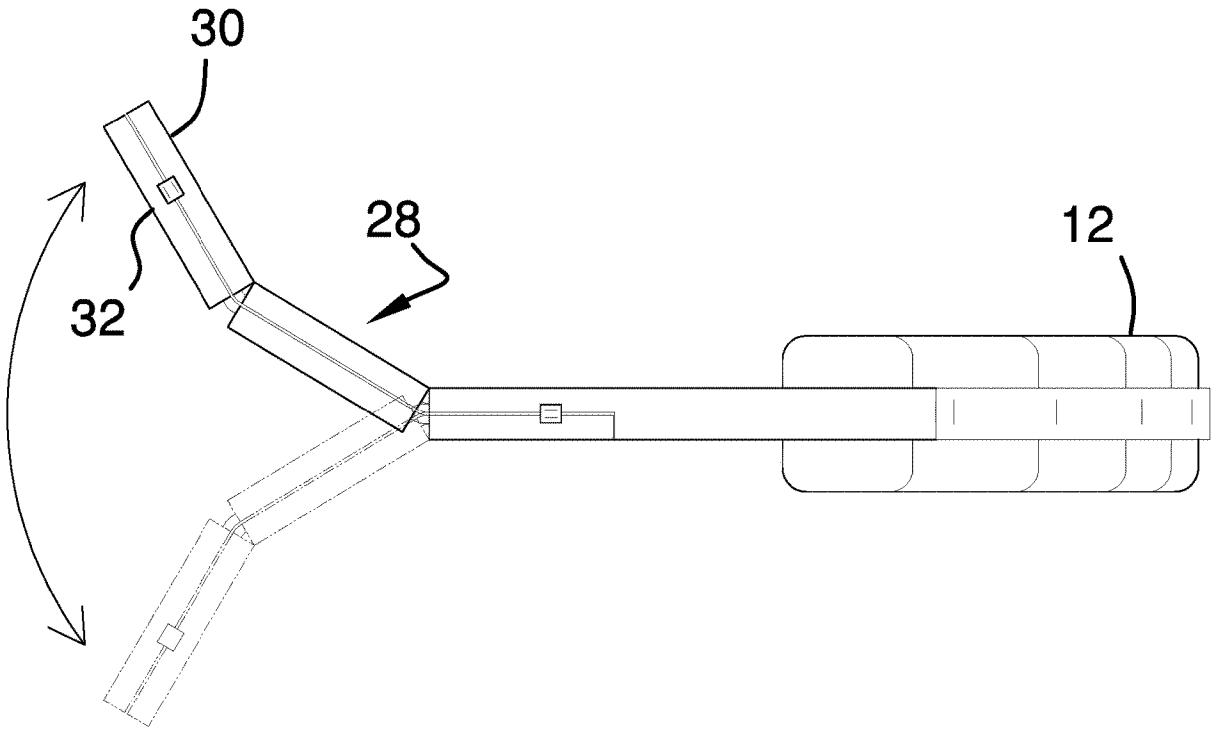
FIG. 6 is a front view of an embodiment of the disclosure showing a blade case being bent.
Figure 7:
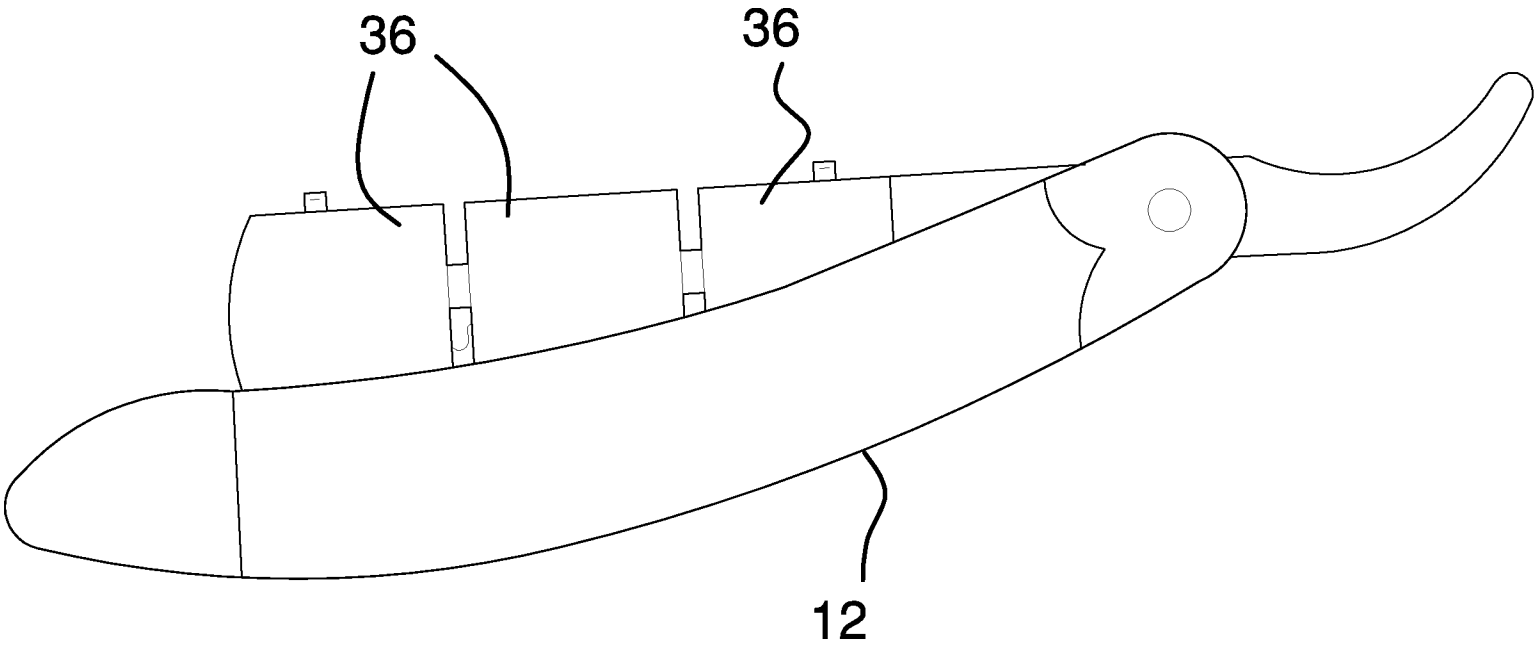
FIG. 7 is a top view of an embodiment of the disclosure showing a lever being positioned in a retracted position.

With reference now to the drawings, and in particular to FIGS. 1 through 7 thereof, a new razor device embodying the principles and concepts of an embodiment of the disclosure and generally designated by the reference numeral 10 will be described.

As best illustrated in FIGS. 1 through 6, the flexible razor assembly 10 generally comprises a handle 12 that has a blade channel 14 integrated therein and the handle 12 has a primary end 16. A lever 18 is pivotally coupled to the handle 12. The lever 18 is positionable in a retracted position having the lever 18 being received into the blade channel 14. Additionally, the lever 18 is positionable in a deployed position having the lever 18 extending away from the handle 12. The lever 18 has a first end 20 and a second end 22, and the lever 18 is pivotally coupled to the handle 12 at a pivot point 24 that is centrally positioned between the first end 20 and the second end 22. The lever 18 is connected to the primary end 16 of the handle 12 and the lever 18 has a curved portion 26 that is positioned between the pivot point 24 and the second end 22. The curved portion 26 is manipulated to position the lever 18 between the deployed position and the retracted position.

A blade case 28 is coupled to the lever 18, and the blade case 28 is positionable in an open position and a closed position. The blade case 28 is bendable along a longitudinal axis extending through the lever 18 and the blade case 28. In this way the blade case 28 can to curvature of a user's body, such as the jaw line, the scalp and other curved areas on the user's body. The blade case 28 is received into the blade channel 14 when the lever 18 is positioned in the retracted position. Additionally, the blade case 28 is exposed when the lever 18 is positioned in the deployed position.

The blade case 28 is positioned on the first end 20 of the lever 18 and the blade case 28 is oriented collinear with the longitudinal axis. The blade case 28 comprises a first half 30 that is hingedly coupled to a second half 32. Each of the first half 30 and the second half 32 has a first surface 34. Moreover, the first surface 34 of the first half 30 abuts the first surface 34 of the second half 32 when the blade case 28 is positioned in the closed position.

Each of the first half 30 and the second half 32 comprise a plurality of panels 36 that are movably coupled together. The panels 36 of the first half 30 are positionable at a plurality of angles. The panels 36 of the second half 32 are positionable at a plurality of angles. The first surface 34 of the first half 30 has a plurality of wells 38 extending inwardly therein.

A plurality of pegs 40 is each coupled to and extends upwardly from the first surface 34 of the second half 32 of the blade case 28. Each of the pegs 40 is positioned in a respective one of the wells 38 when the blade case 28 is positioned in the closed position. A blade 42 is comprised of a bendable material and the blade 42 is positionable in the blade case 28 having a cutting edge 44 of the blade 42 being exposed. In this way the cutting edge 44 can shave the user's body. The blade 42 has a plurality of indentations 46 therein and the blade 42 is positionable on the first surface 34 of the second half 32 of the blade case 28. Each of the indentations 46 engages a respective one of the pegs 40 thereby inhibiting the blade 42 from moving when the blade case 28 is closed.

In use, the blade case 28 is positioned in the open position and the blade 42 is positioned in the blade case 28. The blade case 28 is closed to retain the blade 42 in the blade case 28. The blade case 28 and the blade 42 can be bent to conform to contours on the user's body. In this way a barber or the user themselves can cleanly shave curved areas of the user's body with reduced risk on nicks and cuts. The lever 18 is positioned in the retraced position for storing the blade case 28 and the blade 42 in the blade channel 14 in the handle 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A flexible razor assembly for shaving contours of a user's body, said assembly comprising:

a handle having a blade channel being integrated therein;

a lever being pivotally coupled to said handle, said lever being positionable in a retracted position having said lever being received into said blade channel, said lever being positionable in a deployed position having said lever extending away from said blade channel;

a blade case being coupled to said lever, said blade case being positionable in an open position and a closed position, said blade case being bendable along a longitudinal axis extending through said lever and said blade case, said blade case being received into said blade channel when said lever is positioned in said retracted position, said blade case being exposed when said lever is positioned in said deployed position; and a blade being comprised of a bendable material, said blade being positionable in said blade case and having a cutting edge exposed.

2. The assembly according to claim 1, wherein:

said handle has a primary end;

said lever has a first end and a second end, said lever being pivotally coupled to said handle at a pivot point being centrally positioned between said first end and said second end, said lever being connected to said primary end of said handle.

3. The assembly according to claim 2, wherein said lever has a curved portion positioned between said pivot point and said second end, said curved portion manipulable for positioning said lever between said deployed position and said retracted position.

4. The assembly according to claim 2, wherein said blade case is positioned on said first end of said lever, said blade case being oriented collinear with said longitudinal axis, said blade case comprising a first half being hingedly coupled to a second half, each of said first half and said second half having a first surface, said first surface of said first half abutting said first surface of said second half when said blade case is positioned in said closed position.

5. The assembly according to claim 4, wherein each of said first half and said second half comprises a plurality of panels each being movably coupled together, said first surface of said first half having a plurality of wells extending inwardly therein.

6. The assembly according to claim 5, further comprising a plurality of pegs, each of said pegs being coupled to and extending outwardly from said first surface of said second half of said blade case, each of said pegs being positioned in a respective one of said wells when said blade case is positioned in said closed position.

7. The assembly according to claim 6, wherein said blade has a plurality of indentations therein, said blade being positionable on said first surface of said second half of said blade case, each of said indentations engaging a respective one of said pegs thereby inhibiting said blade from moving when said blade case is closed.

8. A flexible razor assembly for shaving contours of a user's body, said assembly comprising:

a handle having a blade channel being integrated therein, said handle having a primary end;

a lever being pivotally coupled to said handle, said lever being positionable in a retracted position having said lever being received into said blade channel, said lever being positionable in a deployed position having said lever extending away from said blade channel, said lever having a first end and a second end, said lever being pivotally coupled to said handle at a pivot point being centrally positioned between said first end and said second end, said lever being connected to said primary end of said handle, said lever having a curved portion positioned between said pivot point and said second end, said curved portion manipulable to position said lever between said deployed position and said retracted position;

a blade case being coupled to said lever, said blade case being positionable in an open position and a closed position, said blade case being bendable along a longitudinal axis extending through said lever and said blade case, said blade case being received into said blade channel when said lever is positioned in said retracted position, said blade case being exposed when said lever is positioned in said deployed position, said blade case being positioned on said first end of said lever, said blade case being oriented collinear with said longitudinal axis, said blade case comprising a first half being hingedly coupled to a second half, each of said first half and said second half having a first surface, said first surface of said first half abutting said first surface of said second half when said blade case is positioned in said closed position, each of said first half and said second half comprising a plurality of panels being movably coupled together, said first surface of said first half having a plurality of wells extending inwardly therein;

a plurality of pegs, each of said pegs being coupled to and extending outwardly from said first surface of said second half of said blade case, each of said pegs being positioned in a respective one of said wells when said blade case is positioned in said closed position; and a blade being comprised of a bendable material, said blade being positionable in said blade case and having a cutting edge exposed wherein said blade having a plurality of indentations therein, said blade being positionable on said first surface of said second half of said blade case, each of said indentations engaging a respective one of said pegs thereby inhibiting said blade from moving when said blade case is closed.

* * * * *